US007021597B2

(12) United States Patent
Vogt

(10) Patent No.: US 7,021,597 B2
(45) Date of Patent: Apr. 4, 2006

(54) SENSOR ALIGNMENT TOOL

(76) Inventor: William R. Vogt, 112 Jordan Rd., Rockaway, NJ (US) 07866

( * ) Notice: Subject to any disclaimer, the term of this patent is extended or adjusted under 35 U.S.C. 154(b) by 69 days.

(21) Appl. No.: 10/769,057

(22) Filed: Jan. 30, 2004

(65) Prior Publication Data

US 2005/0184213 A1 Aug. 25, 2005

(51) Int. Cl.
*A47G 1/16* (2006.01)

(52) U.S. Cl. ..... 248/490

(58) Field of Classification Search ..... 248/490, 248/200, 207, 205.1, 124, 208, 200.1, 316.8, 248/317, 222.4, 220.21, 220.22; 348/546; 81/3.2; 16/94

See application file for complete search history.

(56) References Cited

U.S. PATENT DOCUMENTS 6,871,566 B1 * 3/2005 Niwayama et al. ..... 81/3.2

* cited by examiner

*Primary Examiner*—Robert P. Olszewski
*Assistant Examiner*—Todd M. Epps
(74) *Attorney, Agent, or Firm*—Polster, Lieder, Woodruff & Lucchesi, L.C.

(57) ABSTRACT

A sensor alignment tool (10) for use in the installation of sensors (S), particularly a pair of sensors such as are used in a security system or the like. Once a proper location for the sensors is identified, a mounting base (12*a*–12*d*) for one of the sensors is located adjacent a surface where the sensors are to be installed. The tool is then employed with two sets (16, 20) of adjustment rods (18, 22) to properly locate and align the sensor mounting base for the other sensor. Tolerant mounting washers are used to mount both bases to the surfaces to which they are to be attached. Once the mounting bases are properly aligned, the tool is removed and the sensors installed in their respective mounting bases.

5 Claims, 4 Drawing Sheets

SENSOR ALIGNMENT TOOL

CROSS REFERENCE TO RELATED APPLICATIONS

U.S. patent application Ser. No. 10/251,933 filed Sep. 20, 2002

STATEMENT REGARDING FEDERALLY SPONSORED RESEARCH OR DEVELOPMENT

None

BACKGROUND OF THE INVENTION

This invention relates to tools used for the installation of sensors used in security systems and the like; and more particularly, to a tool for use in installing balanced sensor pairs on doors and door frames and the like, so the sensors are properly aligned.

In co-pending U.S. patent application Ser. No. 10/251,933, there is described a tolerant mounting apparatus which enables an object to readily be secured to a surface so that the object is properly aligned to a reference when installed. In certain system installations, for example, in security systems, sensors are installed in pairs. For proper operation of the system, it is often important that both sensors be properly aligned to a reference and to each other. Heretofore, doing this has required a great amount of time since the installer typically had to use a trial and error method to insure both sensors were aligned to the reference and to each other. The procedure usually involved installing one of the sensors, aligning it, and then installing the other. While both sensors may have been installed in close proximity to a proper alignment, proper operation of the system required that the alignment of one, or both sensors, be adjusted to meet the requirements of the system. Oftentimes, the sensors are installed so that one is attached to a door frame, for example, with the other sensor of the pair being mounted to a door surface. Depending upon on which side of the door the sensor is mounted, the mounting plates to which the sensors are secured, are not adjacent each other. This often results in an installer having to spend a lot of time and effort was required to achieve the proper alignment of the sensors.

BRIEF SUMMARY OF THE INVENTION

The present invention is directed to a tool for use in the installation of sensors, particularly a pair of balanced, magnetic sensors such as are used in a security system or the like. Once a proper location for the sensors is identified, a mounting base for one of the sensors is located adjacent a surface where the sensors are to be installed. An alignment tool of the present invention and two sets of adjustment rods are then used to properly locate and align the sensor mounting base for the other sensor. Tolerant mounting washers are used to mount both bases to the surfaces to which they are to be attached. Once the mounting bases are properly aligned, the tool is removed and the sensors installed in their respective mounting bases.

It is a feature of the invention to provide a tool which facilitates an accurate alignment but one which is also easy to use and enables alignment to be readily achieved. In addition, the tool can be used with a variety of sensor mounting bases and a variety of mounting configurations.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 1:
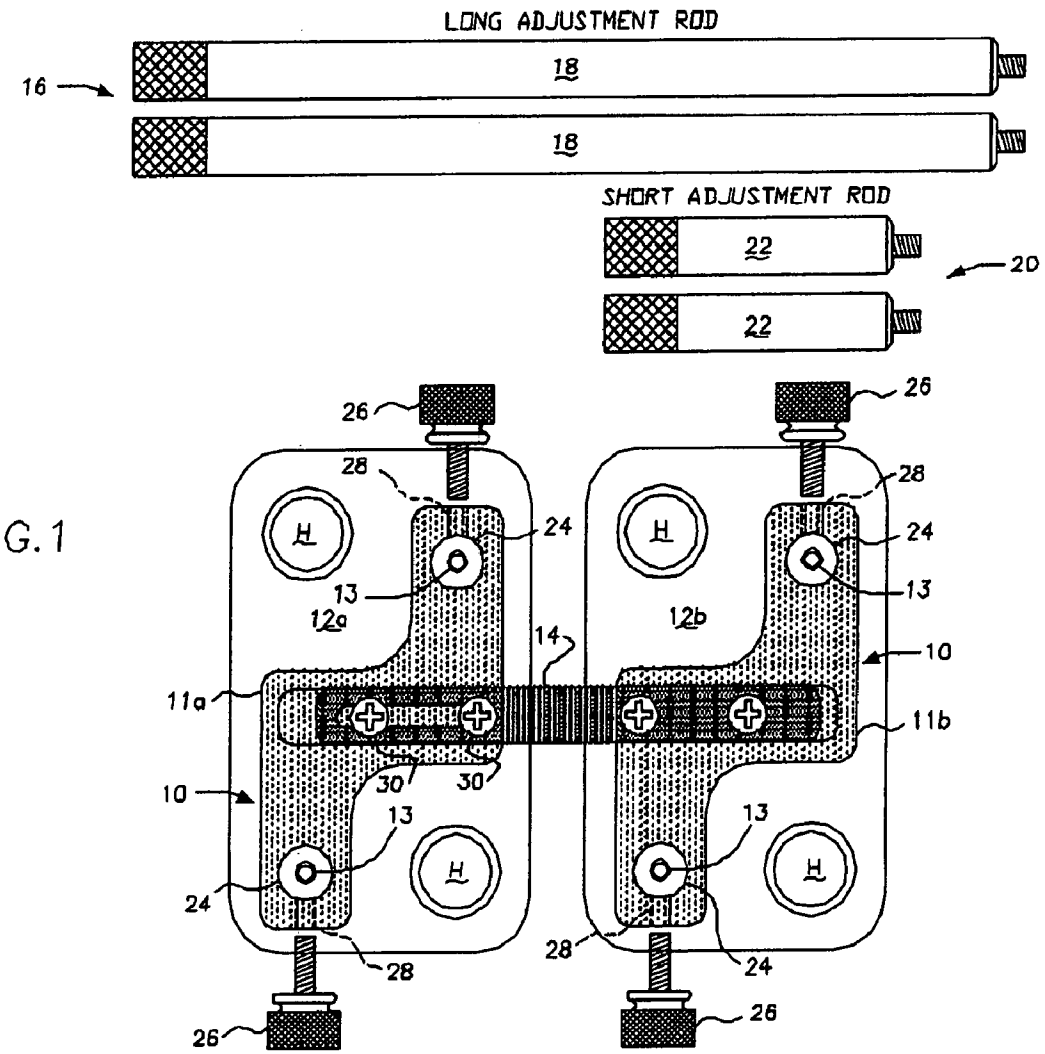
FIG. 1 illustrates a sensor alignment tool of the present invention and its associated components.

In accordance with the invention, an alignment tool or fixture 10, shown in FIG. 1, is designed to establish and maintain a proper alignment between mounting brackets 12 for a pair of mating or matching sensors S during a sensor installation process. Those skilled in the art will understand that the pair of sensors S typically comprises a sensor such as, for example, a switch, and a magnet for activating the switch.

As more fully described hereinafter, the installation process includes the following steps:

1) mounting and positioning one of the sensor mounting bases 12*a;*

2) attaching tool 10 to a set of pre-tapped holes 13 used to mount the sensor to base 12*a* using two sets 16, 20 of adjustment rods;

3) attaching the second sensor mounting base 12*b* to tool 10 using the holes 13 in this second mounting base, which are used to mount the mating sensor S, and using the two sets of adjustment rods;

4) using tool 10 to hold the two mounting bases in a proper relationship (spacing and alignment) to each other while washers (not shown) are aligned with holes H in both bases, and mounting screws are inserted and lightly tightened; and, 5) removing tool 10 and tightening the mounting screws securely.

The sensors S are then attached to the pre-mounted sensor bases.

Referring to FIG. 1, a sensor alignment tool of the present invention is indicated generally 10. As noted, the tool is used to properly position and align sensor mounting plates 12*a* and 12*b*. Each plate 12*a*, 12*b* has a pair of holes H formed therein by which the plates are mounted to a surface using mounting washers and screws. Tool 10 includes a pair of generally S-shaped brackets 11*a*, 11*b* respectively whose alignment and spacing relative to each other is adjusted by adjustment bar 14 which is fixedly attached to bracket 11*b* and adjustably attached to bracket 11*a* as shown in FIG. 1.

Two pairs of adjustment rods are used with the tool. As shown in FIG. 1, these include a pair 16 of long adjustment rods 18, and a pair 20 of short adjustment rods 22. Each adjustment rod has a threaded end which is screwed into threaded holes 13 located at each end of the respective brackets 11*a*, 11*b*. While adjustment rods are fitted in the holes 13 during the alignment process, the sensors S are ultimately attached to the bases 12*a*, 12*b* using these holes. For this purpose, each sensor has a base with clearance holes for fasteners. These are correspondingly threaded for attachment to the holes 13. Thumbscrews 26 are provided for holding the adjustment rods in holes 24 after they are screwed into the holes in the plates. The thumbscrews are threaded into tapped holes 28 to press against a rod 18 or 22 which is inserted into a hole 24.

For purposes of installing a pair of sensors S in proper alignment, brackets 11*a* and 11*b* of tool 10 are aligned with each other using bar 14. Tool 10 then holds rods 18 and 22 in a proper alignment after they are attached to the brackets. Finally, the rods 18, 22 holds plates 12*a* and 12*b* in alignment while they are mounted to the respective surfaces; e.g., a door and door frame.

The sensor bases 12*a*, 12*b* are designed to allow for a hole for a #6 screw, for example, to be drilled within a hole H which is, for example, a ½" diameter hole. Once the sensor bases 12*a*, 12*b*, have been properly installed, tool 10 is removed. Then, the sensors S comprising the sensor pair are attached to their bases (threaded into the appropriate holes 13, for example) to complete the installation.

In the following example, a sensor alignment tool 10 of the present invention is used to assist in mounting the bases by holding and maintaining an alignment between the bases while they are installed on a Frame and a Door. The gap between the sensors is set by loosening the screws 30 on the one end of adjustment bar 14, sliding the brackets closer together or farther apart until a desired gap is attained. Once the desired gap is established, the screws 30 are re-tightened. The adjustment range is, for example, from ¼" to ½", and the adjustment bar is marked, for example, in 1/32" increments to assist in setting the desired gap.

Figure 2:
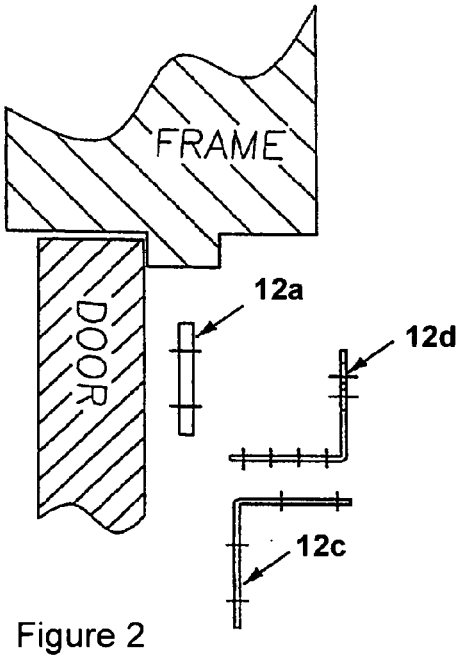
FIGS. 2–11 illustrate use of the tool to install a pair of sensors in a properly aligned position; and, FIGS. 12A–12D illustrate various sensor mounting arrangements.

Referring to FIG. 2, the first step in the installation process is identify the proper location for the sensors, select an appropriate mounting base 12, and appropriate hardware for mounting the sensor with that the selected base. In FIG. 2, two sensor mounting bases 12*c* and 12*d* are shown in addition to base 12*a*. In the following example, bases 12*c* and 12*d* are used.

Figure 3:
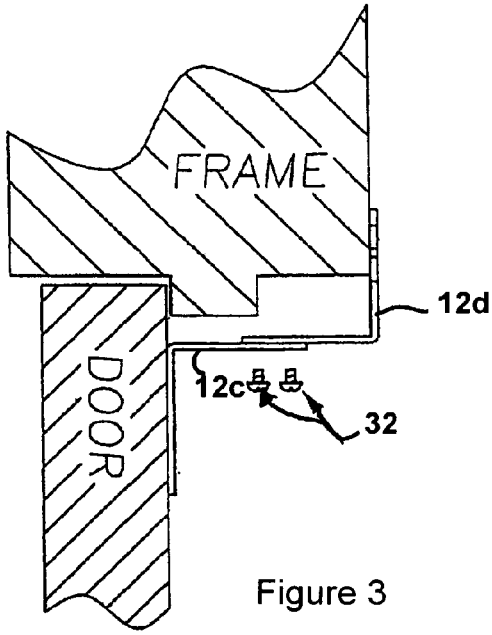
Figure 4:
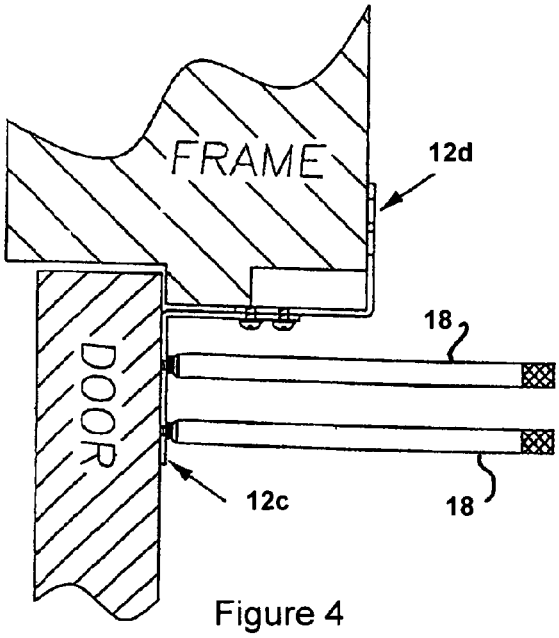
Figure 5:
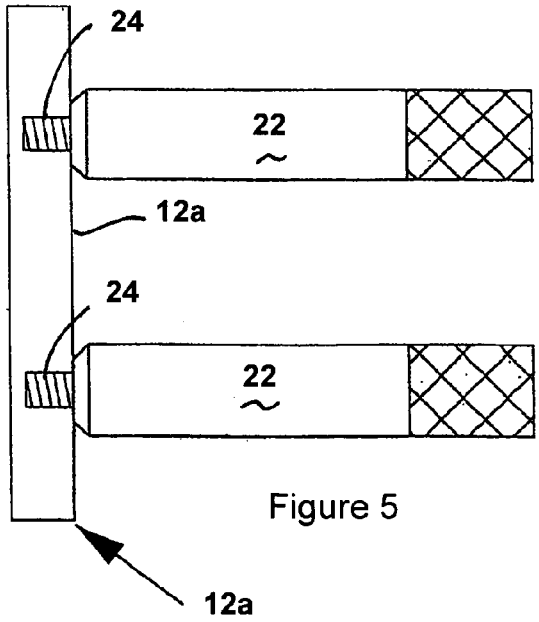

Next, as shown in FIG. 3, base 12*d* is attached to the frame using mounting washers (not shown). Mounting base 12*c* is then attached to base 12*d* using screws 32. This step requires abutting base 12*c* against the door's surface and temporarily tightening the screws 32. Next, mounting base 12*d* is securely attached to the frame in its desired position. Once this is accomplished, the adjustment rods 18 of set 16 are attached to the sensor mounting base 12*c* by threading them into the holes 13 in which a sensor S is installed. This is as shown in FIG. 4. At this time, mounting bases 12*c* and 12*d*, having been securely attached to the frame, are supporting adjustment rods 18 of set 16. The adjustment rods 22 of set 20 are correspondingly fitted into the holes 13 of sensor mounting base 12*a*. This is as shown in FIG. 5.

Figure 6:
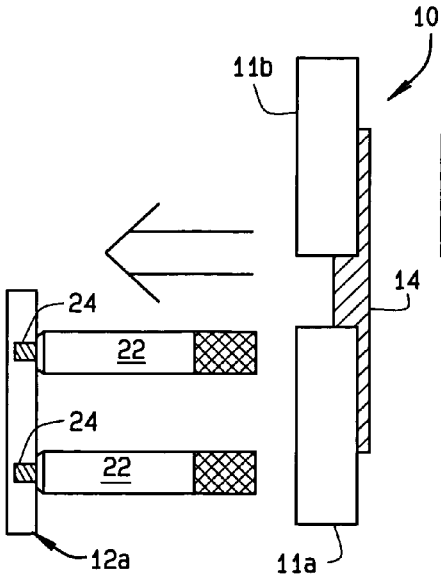
Figure 7:
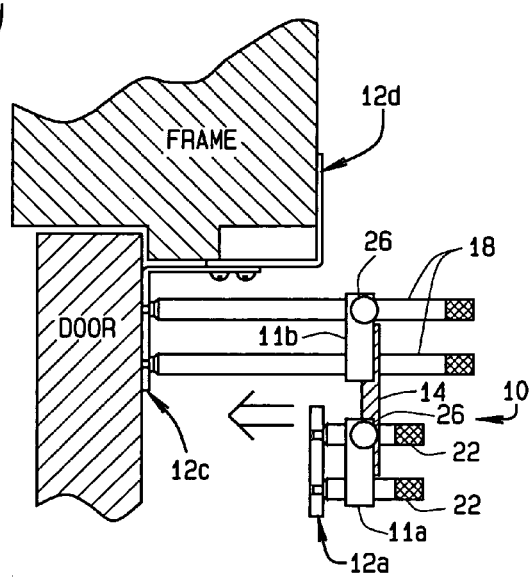

Next, if not previously done, brackets 11*a* and 11*b* are adjusted, using adjustment bar 14 to produce the desired gap between the sensors when they are installed. Then, as shown in FIG. 6, bracket 11*a* of the alignment tool is slid over the adjustment rods 22, with the rods fitting through the holes 24 in the bracket. When there is a gap of, for example, ½" between sensor mounting base 12*a* and bracket 11*a*, the thumbscrews 26 are tightened to lock the sensor base to the alignment tool. Next, as shown in FIG. 7, the tool 10/bracket 11*a* sub-assembly is fitted over the adjustment rods 18 with the rods extending through the holes 24 in bracket 11*b*. The sub-assembly is moved to the left, in accordance with the direction arrow in FIG. 7, until sensor mounting base 12*a* abuts against the surface of the door. Then, the thumbscrews 26 are tightened against the rods 18. Now, the adjustment rods 18 support alignment tool 10. Alignment tool 10 is, in turn, supporting adjustment rods 22 of set 20. These adjustment rods are supporting sensor base 12*a* in alignment with bases 12*c* and 12*d*.

Figure 8:
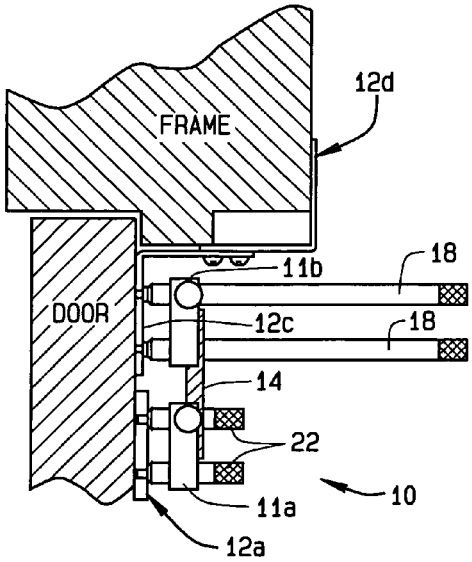

Referring to FIG. 8, once the above has been completed, sensor mounting base 12*a* is physically supported in its proper position and is easily mounted to the door using tolerant mounting washers and fasteners such as shown and described in applicant's co-pending U.S. patent application Ser. No. 10,251,933. At this time, sensor mounting base 12*a* has been aligned "Left/Right", "Up/Down", and Parallel to sensor mounting base 12*c*. Now, it is only necessary to properly align the "In/Out" mounting surfaces of these bases.

Figure 9:
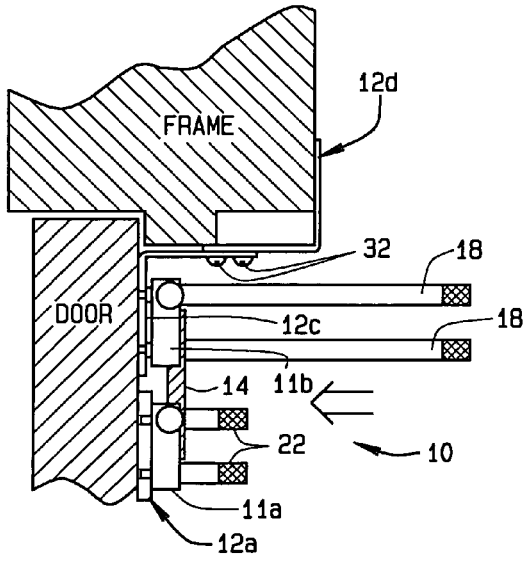

To do this, the four thumbscrews 26 securing the respective adjustment rods 18 and 22 to the alignment tool brackets 11*b* and 11*a* respectively are loosened. This allows alignment tool 10 to slide along the respective rods, as indicated by the arrow in FIG. 9, until the tool is flush with outer surface of sensor mounting base 12*a*. The thumbscrews 26 on bracket 11*a* are then tightened against the rods 22 to hold tool 10 against base 12*a*.

Figure 10:
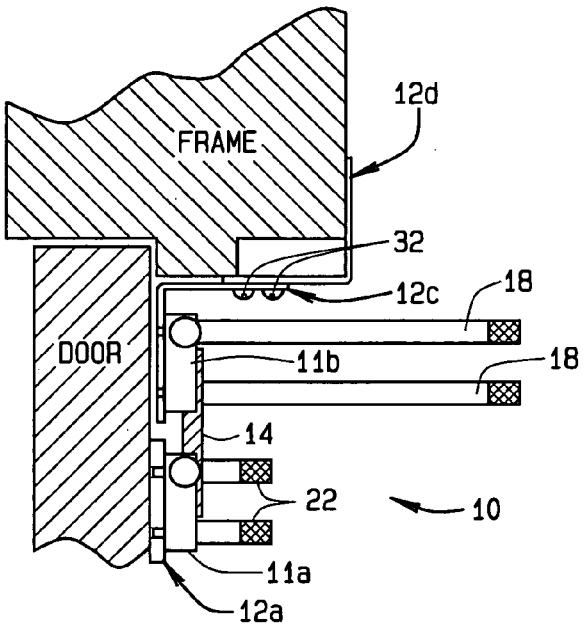

Now, the screws 32 connecting sensor mounting bases 12*c* and 12*d* are loosened. Then, as shown in FIG. 10, the installer pulls on the adjustment rods 18 connected to the mounting base 12*c* until the mounting base is flush with the tool 10. When this is done, the installer tightens the thumbscrews 26 on bracket 11*b* against the rods 18. Sensor mounting base 12*c* is now properly aligned "Left/Right", "Up/Down", "In/Out". The screws 32 are again tightened to connect mounting bases 12*c* and 12*d*.

Figure 11:
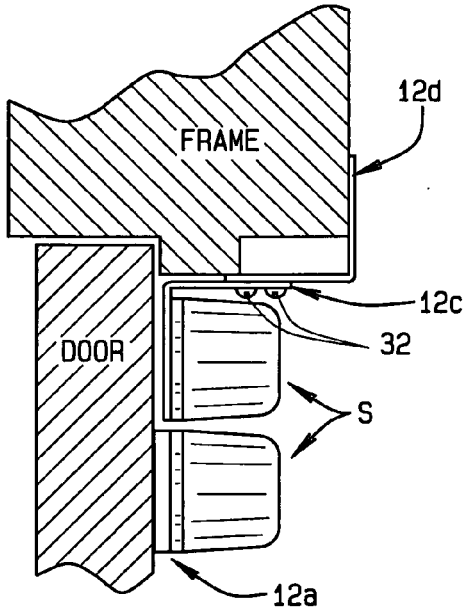

When this is done, all of the thumbscrews 26 holding the adjustment rods 18 and 12 to the respective brackets 11*a* and 11*b* of tool 10 are loosened. This allows tool 10 to be removed from the assembly. After removing the tool, all of the adjustment rods are unscrewed from the respective mounting bases 12*a* and 12*c*. After removing the rods, the sensors are installed in the pre-aligned bases 12*a*, 12*c*. This is as shown in FIG. 11. Once the sensors are in place, they are connected into the system with which they are used and tested for their operational capability.

Figure 12A:
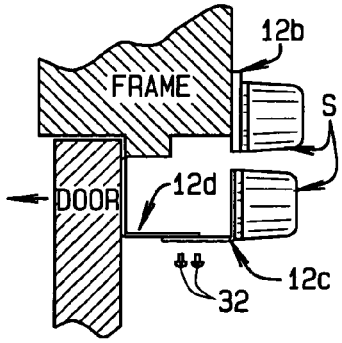
Figure 12B:
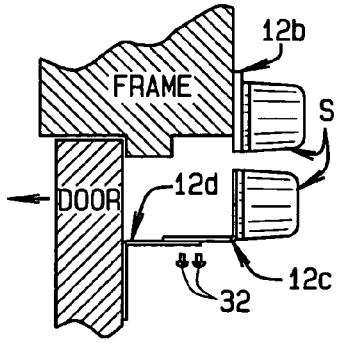
Figure 12C:
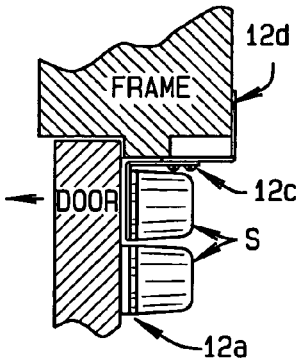
Figure 12D:
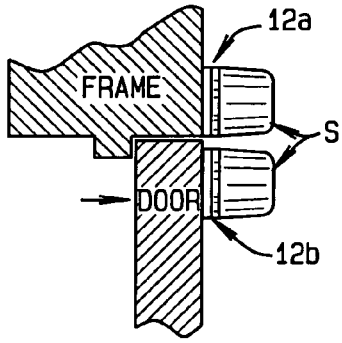

Finally, referring to FIGS. 12A–12D, a variety of sensor installations are shown in which proper, aligned installation of the pair of sensors S is shown. In each instance, alignment of the sensors is achieved using tool 10, and adjustment rods 18 and 22 in a manner similar to that described above. It will be noted that the installation of FIG. 12C is a preferred installation and was the installation described hereinabove. Those skilled in the art will appreciate that other sensor installations are also possible without departing from the scope of the invention.

In the preferred embodiment, alignment tool 10 is used to align and assist in the installation of sensor mounting bases 12. These are attached to surfaces prior to the actual sensors S being secured to the mounting bases. Those skilled in the art will appreciate that the sensor bases 12 can be made so as to accept the adjustment rods, thereby enabling alignment tool 10 to directly align and assist in the installation of the mounting bases. This eliminates the plates 11*a,* 11*b,* of tool 10 and reduces the cost of the tool. Now, tool 10 can align and assist in the installation of the final part itself, a portion of a product to be installed, or a secondary product to which the final product is attached. Those skilled in the art will further appreciate that while theforegoing discussion was directed to the installation of sensors, the alignment tool and method of the present invention can be used to install other devices as well in an aligned fashion.

In view of the above, it will be seen that the several objects and advantages of the present invention have been achieved and other advantageous results have been obtained.

Having thus described the invention, what is claimed and desired to be secure by Letters Patent is:

1. A tool for use in the installation of a pair of sensors in a system utilizing an output from the sensors and requiring that the sensors be aligned in a predetermined manner for their proper operation, comprising:

a pair of brackets whose position is adjustable relative to each other, one of the brackets used with a first mounting base for a first of the sensors, and the other bracket used with a second mounting base for a second of the sensors;

means for adjusting the position of the brackets relative to each other and including a bar fixedly attached to one of the brackets and adjustably attached to the other of the brackets, the bar allowing the brackets to have a predetermined gap between them and the brackets to be aligned to each other; and, means for aligning the second mounting base with respect to the first mounting base, after the first mounting base has been installed so the second mounting base is aligned with the first mounting base and the first sensor with the second sensor, and including a pair of adjustment rods which are temporarily attached to one of the bases while the bases are aligned and then removed for installation of a sensor to the base.

2. The tool of claim 1 in which the means for aligning includes a second pair of adjustment rods which are temporarily attached to the other of the bases while the bases are aligned and then removed for installation of the other sensor to the other base.

3. The tool of claim 2 in which the adjustment rods comprising one pair of rods are longer than the adjustment rods comprising the other pair.

4. Apparatus for establishing and maintaining a pair of objects in a predetermined alignment relative to each other comprising:

a fixture having a first bracket and a second bracket and means for adjusting a distance between the two brackets, the means for adjusting the distance between the brackets including a bar fixedly attached to one of the brackets and adjustably attached to the other of the brackets, the bar allowing the brackets to be moved a predetermined distance between them and for the brackets to be aligned to each other;

a pair of mounting bases for the objects, one of the bases being installed on one surface and the other base being installed on another surface; and, means for connecting the first bracket to one of the bases, and means for connecting the second bracket to the other of the bases, both the connecting means maintaining a preferred alignment and distance between the connecting means and its respective base during installation of the bases to the surfaces, the first said means for connecting including a pair of adjustment rods which are temporarily attached to one of the bases while the bases are aligned and then removed for installation of a sensor to the base.

5. The apparatus of claim 4 in which the second connecting means includes a second pair of adjustment rods which are temporarily attached to the other of the bases while the bases are aligned and then removed for installation of the other sensor to the other base.

* * * * *